US006079233A

United States Patent [19]

Shima

[11] Patent Number: 6,079,233

[45] Date of Patent: Jun. 27, 2000

[54] FLAT KNITTING MACHINE WITH MOVABLE LOOP FORMING PLATES

[75] Inventor: Masahiro Shima, Wakayama, Japan

[73] Assignee: Shima Seiki Manufacturing, Ltd., Sakata Wakayama, Japan

[21] Appl. No.: 09/132,261

[22] Filed: Aug. 11, 1998

[30] Foreign Application Priority Data

Aug. 11, 1997 [JP] Japan ..... 9-216234

[51] Int. Cl.[7] ..... D04B 15/06

[52] U.S. Cl. ..... 66/106; 66/64; 66/109

[58] Field of Search ..... 66/104, 106, 107, 66/109, 110, 60 R, 64

[56] References Cited

U.S. PATENT DOCUMENTS 5,305,620 4/1994 Yabuta ..... 66/109
5,333,473 8/1994 Miyamoto ..... 66/106
5,475,991 12/1995 Yabuta et al. ..... 66/106
5,636,532 6/1997 Shima et al. ..... 66/64
5,918,483 7/1999 Schmid et al. ..... 66/64

FOREIGN PATENT DOCUMENTS 0 672 770 9/1995 European Pat. Off. .
3-75656 12/1991 Japan .

*Primary Examiner*—Danny Worrell
*Attorney, Agent, or Firm*—Arent Fox Kintner Plotkin & Kahn PLLC

[57] ABSTRACT

Grooves for receiving a movable loop forming plate are made in both front and back needle beds at the top ends thereof on the trick gap side, and movable loop forming plates are mounted in the grooves. A loop forming edge is provided at the top end of each movable loop forming plate, and the plate is energized by a spring in a direction that the plate moves away from the trick gap, and the plate is made to move forward or backward by a movable loop forming plate control means, around a fulcrum that is provided on the needle bed in the bottom of the trick gap.

6 Claims, 9 Drawing Sheets

FIG. 7-A
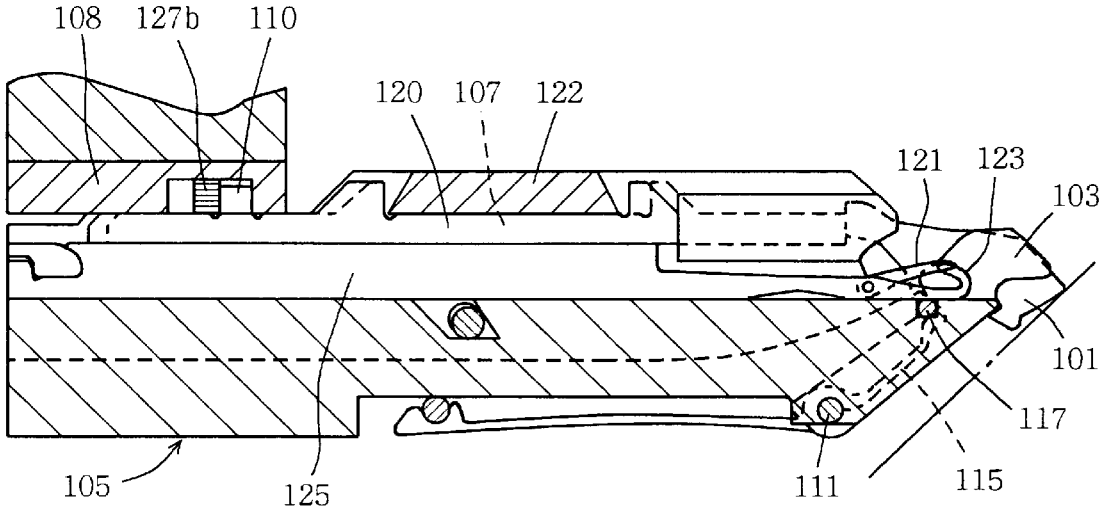
FIG. 7-B
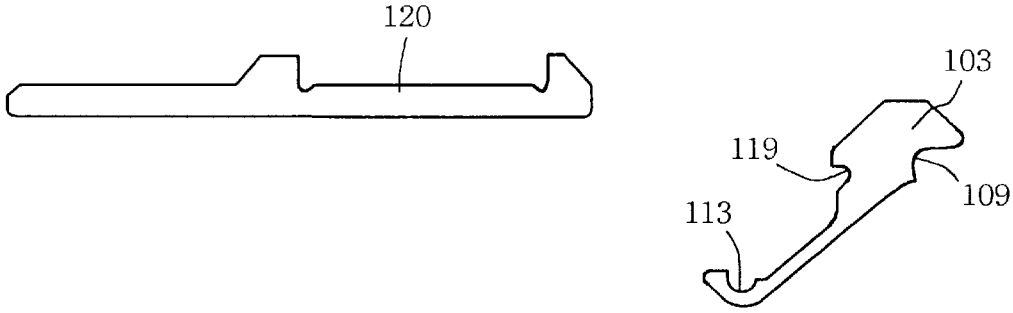
FIG. 7-C
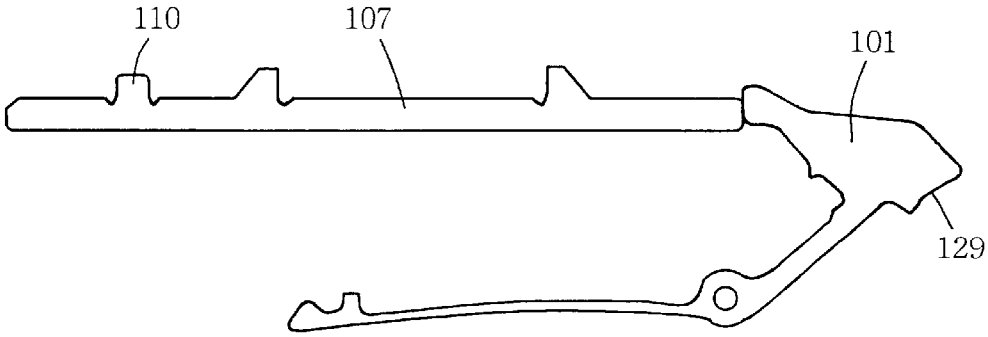

FIG. 10-A
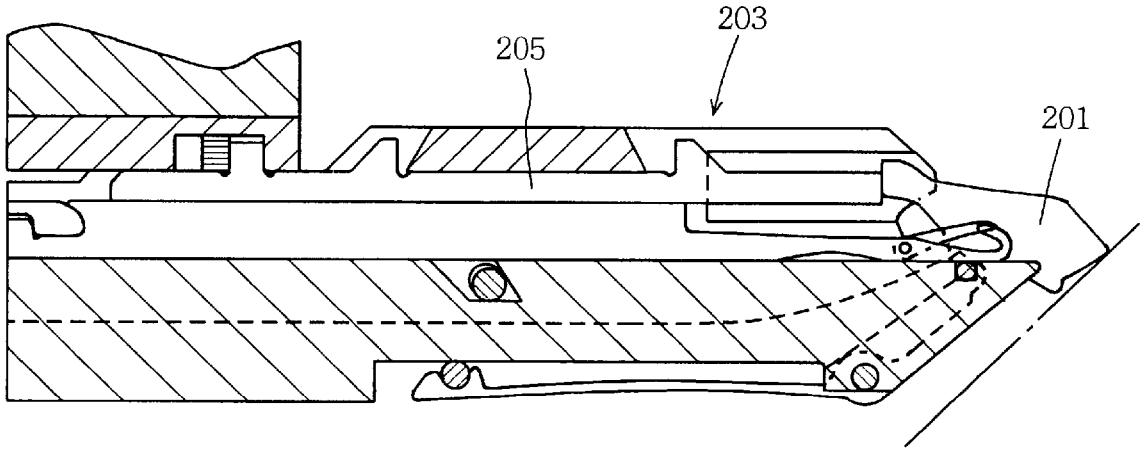
FIG. 10-B
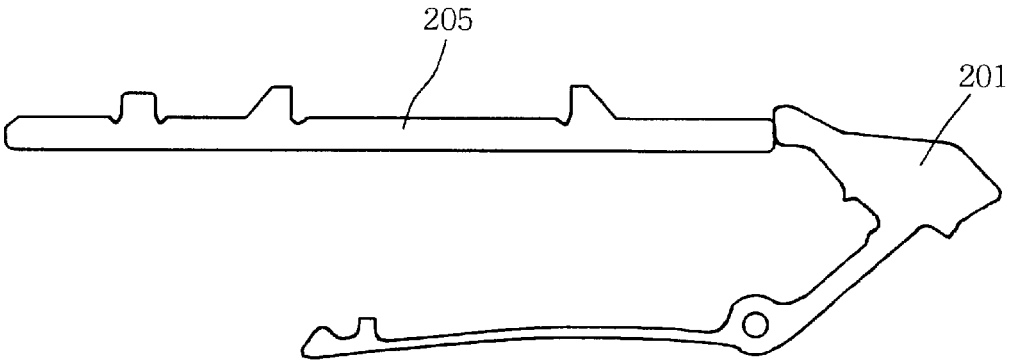

FIG. 11-A
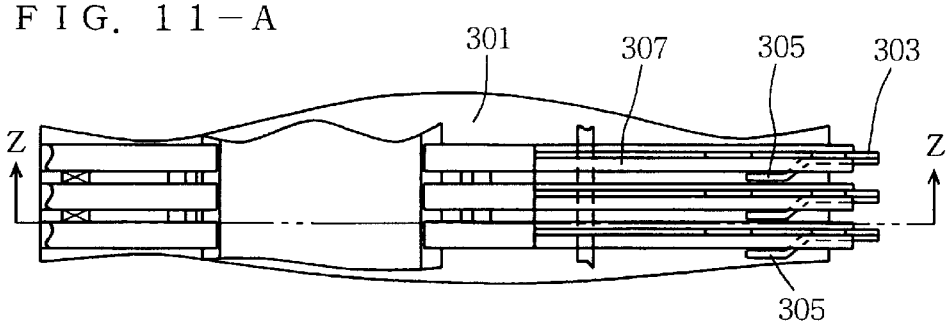
FIG. 11-B
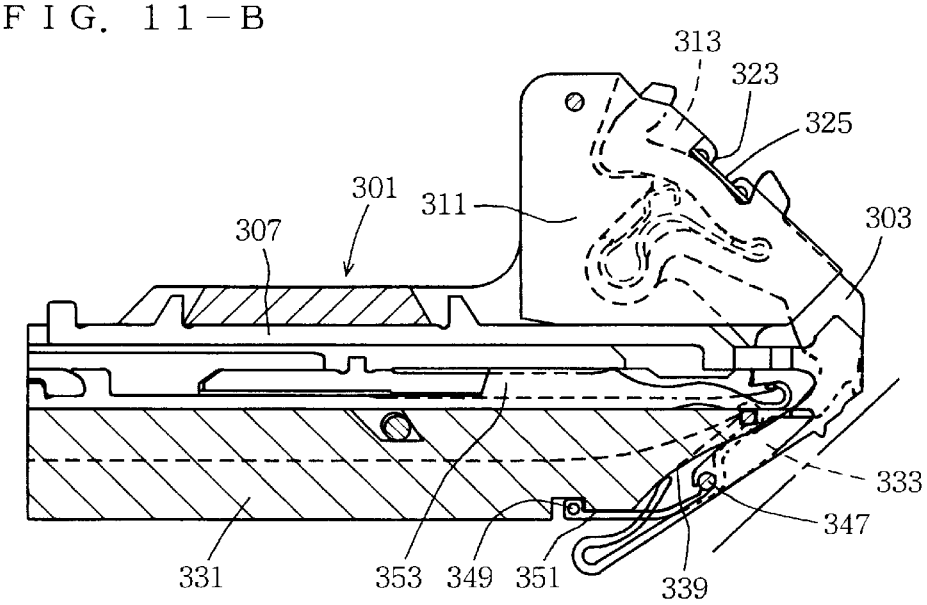
FIG. 11-C
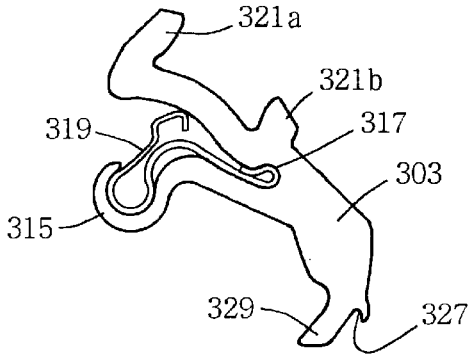
FIG. 11-D
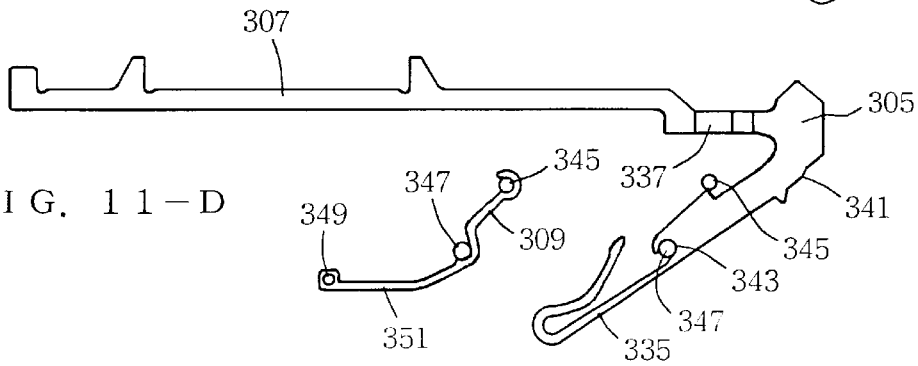

FLAT KNITTING MACHINE WITH MOVABLE LOOP FORMING PLATES

FIELD OF THE INVENTION

The present invention relates to a flat knitting machine having at least a pair of a front needle bed and a back needle bed, said flat knitting machine is provided with movable loop forming plates between needles, said movable loop forming plate is provided with a loop forming edge that faces the opening between both the front and back needle beds on the trick gap side of the needle bed and said movable loop forming plate can be moved forward and backward between an advanced position in which the loop forming edge is advanced the most towards the opening between both the front and back needle beds and a retracted position in which the loop forming edge is retracted the most.

PRIOR ART

A knitting method is disclosed in Japanese Patent Hei 3-75656, that is used when, on a flat knitting machine with two beds wherein a pair of needle beds are arranged to oppose, one in the front and the other in the back, a tubular fabric is formed with a front fabric and a back fabric being connected with each other at both ends thereof. According to the method, needles for forming the front fabric and needles for forming the back fabric are arranged alternately on the needle bed, and knitting is made under a condition that only one needle, of the pair of opposing front and back needles, is holding a loop. According to this method, every other needle of the front needle bed is used to knit the front fabric, every other needle of the back needle bed is used to knit the back fabric, empty needles, that are arranged between the every other needle for forming loops, are used to transfer loops between the front and back needle beds, and a tubular fabric is shaped; thus a fabric called an unsewn knit can be knitted by connecting shaped fabrics in the course of knitting to eliminate or significantly reduce the need of sewing steps after the completion of knitting. In this knitting method, knitting of the front fabric and of the back fabric is effected by using every other needle on the needle bed. In the present specification, this is called half knitting. This uses so-called empty needles, and the pitch of the needles used in knitting is twice as large as the pitch of the needles arranged on the beds, even when both needles of the front and back needle beds are totaled. Knitting that uses all needles is called full knitting, and the pitch of the needles used in knitting is equal to that of the needle arrangement of the needle beds, irrespective of plain stitch or rib stitch, when the needles of both the front and back needle beds are totaled. In half knitting, between two needles that are used for knitting one fabric, are provided a needle that is used for knitting the other fabric (front fabric or back fabric) and two sinker plates. Hence the sinker loop is expanded relative to the needle loop in the knitted fabric, and this lowers the market value of the fabric.

To solve the above problem, Japanese Provisional Patent Hei 7-258945 (EP 672770A) discloses a flat knitting machine having a pair of a front and back needle beds wherein a first needle and a second needle are arranged between a pair of adjacent sinker plates and the first needle is used to knit a front fabric and the second needle is used to knit a back fabric. In the flat knitting machine disclosed in Japanese Provisional Patent Hei 7-258945, a sinker plate is provided for every two needles, hence, even when half knitting is made, no sinker loop is subjected to effects of two sinker plates. Thus half knitting can be made while the balance between sinker loop and needle loop is prevented from being upset. However, the flat knitting machine that is disclosed in Japanese Provisional Patent Hei 7-258945 is arranged to keep the balance between needle loop and sinker loop by making half knitting. As a result, it poses a problem of irregular spacing between wales in full knitting.

In the case of a flat knitting machine having conventional fixed sinkers or movable sinkers, when a knitted structure that is knitted by using only one needle bed, such as plain stitch structure, and a knitted structure that is knitted by using needles of both front and back needle beds, such as rib stitch structure, are mixed in the same course, it poses a problem that the sinker loop of the knitted structure that is knitted by using both the front and back needle beds is larger relative to the sinker loop of the knitted structure that is knitted by using only one needle bed. The cause of this problem is as follows. In the knitted structure that is knitted by using both the front and back needle beds, the yarn portion spanning over the trick gap between both the front and back needle beds is absorbed into the sinker loop. On the other hand, in the knitted structure that is knitted by using needles of only one needle bed, there is no counterpart that corresponds to the yarn portion spanning the trick gap. This difference appears as the difference in sinker loop length.

SUMMARY OF THE INVENTION

In view of the above problems, one object of the present invention is to perform both half knitting and full knitting while preventing the balance, in size, between sinker loop and needle loop from being disturbed.

Another object of the present invention is, when a knitted fabric knitted by using only one of the front and back needle beds, such as plain stitch structure, and a knitted fabric knitted by using both the front and back needle beds, such as rib stitch structure, are combined, to adjust the difference in sinker loop size between the different knitted structures.

Another object of the present invention is to adjust the balance in sinker loop length between a knitted structure that uses only one of the front and back needle beds and a knitted structure that uses both the front and back needle beds without altering the mounting position of any needle bed.

Furthermore, another object of the present invention is to realize a desired texture or feeling by controlling the position of the movable loop forming edge according to the properties of a yarn used in knitting and other knitting conditions, and in turn, adjusting the amount of push-out of the sinker loop.

To solve the above problems, a flat knitting machine with movable loop forming plates according to the present invention is a flat knitting machine having at least a pair of needle beds, each holding a plurality of needles held slidably in needle grooves formed on said needle beds, said needle beds abutting with each other, at top ends of said needle beds, leaving an opening between the top ends, and at least one of said needle beds being slidable sideways, wherein said needles are slidable to and away from said opening, characterized in that said needle beds are provided a plurality of movable loop forming plates movable to and away from said opening in parallel with said needles, that each of said movable loop forming plates is provided a loop forming edge at a top end of the plate facing the opening, and that said flat knitting machine is provided control means for moving said movable loop forming plates so that said loop forming edges move to and away from said opening.

With this arrangement, by making the loop forming edge of a movable loop forming plate move to and away from said opening, a forward/backward movement locus of the loop forming edge optimized to push-out of the sinker loop is easily realized.

Preferably, said movable loop forming plates are sunk partly in grooves formed on bottoms of the needle beds facing the opening, wherein said movable loop forming plates are supported by said grooves and free to rock so as to advance towards and retract from the opening according to the control of said control means.

Preferably, said movable loop forming plates comprise a first kind of movable loop forming plates and a second kind of movable loop forming plates, each kind being plural, and said control means comprises first control means for moving said first kind of movable loop forming plates to and away from the opening and second control means for moving said second kind of movable loop forming plates to and away from the opening so that one of half knitting, wherein loop forming edges of said first kind of movable loop forming plates are made active by said first control means and loop forming edges of said second kind of movable loop forming plates are made inactive by said second control means so as to feed every other of said needles with yarn, and full knitting, wherein loop forming edges of said first kind of movable loop forming plates and said second kind of movable loop forming plates are both made active by said first control means and second control means so as to feed each of said needles with yarn, is selectively performed. In this way, both full knitting and half knitting are made while the balance between sinker loops and needle loops is kept without disturbance.

Further, preferably, said movable loop forming plates are provided to needles being one of every two of said needles, and fixed loop forming plates are provided to remaining needles so that both half knitting, wherein the loop forming edges of the movable loop forming plates are advanced towards the opening so as to feed every other needle with yarn, and full knitting, wherein the loop forming edges of the movable loop forming plates are retracted from the opening so as to feed each needle with yarn, are enabled. In this way, both full knitting and half knitting may be made while the balance between sinker loop and needle loop is prevented from being disturbed.

Preferably, a plurality of movable sinker plates are provided so that each of said movable sinker plate is overlapped with one of said movable loop forming plate, said movable sinker plates are provided, at a top end thereof, with yarn holding means for holding yarn spanned between needles and movable forward to and backward from the opening and prevent old loops held by needles from being raised during forward movement of the needles, and each of said yarn holding means and a loop forming edge overlapped with it are made to cross with each other by the forward/backward movement of the movable sinker plate and the forward/backward movement of the movable loop plate. With this arrangement, yarn held by the yarn holding means of the movable loop forming plate is caught reliably by the yarn holding means of the movable sinker plate, and a function of the movable sinker plate as a loop forming edge can be eliminated. Thus the movable sinker plate can be dedicated to a single purpose of pulling down a loop, and the configuration and travel locus of the movable sinker plate can be optimized for pulling down a loop.

Further, preferably, said control means moves adjustably said movable loop forming plates towards the opening to one of plural positions. As a result, the difference in sinker loop length between different knitted structures is reduced, abrupt changes in texture between different knitted structures and undesired changes in texture are prevented; thus fabrics of higher market value are knitted. Moreover, when the amount of advancement of the movable loop forming plate is adjusted according to the knitting conditions such as properties of the yarn and take-down tensions of the fabric, the knock-over timing can be adjusted. As a result, a fabric of the desired texture or feeling can be knitted.

Preferably, said loop forming edges are pressed by pressing members so as to move away from a center of said opening, and wherein said control means makes said loop forming plates move towards the center of said opening against the press by the pressing members. With this arrangement, the pressing members prevent the movable loop forming plate from advancing beyond the center of the opening between the needle beds, and in turn, prevents interference between the movable loop forming plate and any needle or loop forming plate at the top end of the opposing needle bed. Moreover, the positions of the loop forming edges when the movable loop forming plates are advanced can be aligned. Furthermore, it is not necessary for the control means to retractthe loop forming edge, and thus the structure can be simplified.

Preferably, said bottoms of the needle beds facing the opening are provided with fulcrums for the rocking motion of the movable loop forming plates, each of said pressing member is configured by an elastic leg provided in each of said loop forming plates and extending from one of said fulcrums oppositely to the loop forming edge of said each of said loop forming plates, and said elastic leg is in contact with the bottom of the needle bed supporting said each of said loop forming plates. In this way, movable loop forming plates are provided without any structure that may hinder knitting on the needle beds or in the pull-down loci of fabrics.

BRIEF DESCRIPTION OF THE DRAWINGS

FIGS. 2A,B,C shows the needle bed of the first embodiment and movable loop forming plates thereof.

FIG. 2-B and FIG. 2-C are drawings showing the movable loop forming plates and the movable loop forming plate control members of FIG. 2-A in disassembled forms.

FIGS. 7A,B,C shows a needle bed of a second embodiment and a movable loop forming plate thereof.

FIG. 7-A is a sectional view of the needle bed.

FIG. 7-B and FIG. 7-C are diagrams showing a fixed loop forming plate and the movable loop forming plate of FIG. 7-A in disassembled forms.

FIGS. 10A,B shows a needle bed of a third embodiment and a movable loop forming plate thereof.

FIG. 10-A is a sectional view of the needle bed.

FIG. 10-B is a diagram showing the movable loop forming plate of FIG. 10-A in a disassembled form.

FIGS. 11A,B,C,D shows a needle bed of a fourth embodiment and a movable loop forming plate and a holding member thereof FIG. 11-A is a plan view of the needle bed.

FIG. 11-B is a sectional view along the line Z—Z of FIG. 11-A.

FIG. 11-C shows a movable sinker plate.

FIG. 11-D shows the movable loop forming plate, a movable loop forming plate control member, and the holding member.

EMBODIMENTS

Embodiments of the flat knitting machine of the present invention will be described in detail with reference to the attached drawings. In these embodiments, for the sake of simplicity, knit operation or miss operation will be described by way of example. However, the present invention can be implemented on a conventional flat knitting machine that has transfer function and tuck knitting function. In these embodiments, a yarn portion that extends between needle loops is called a sinker loop, irrespective of single bed knit structure and double beds knit structure.

<First Embodiment>

Figure 1:
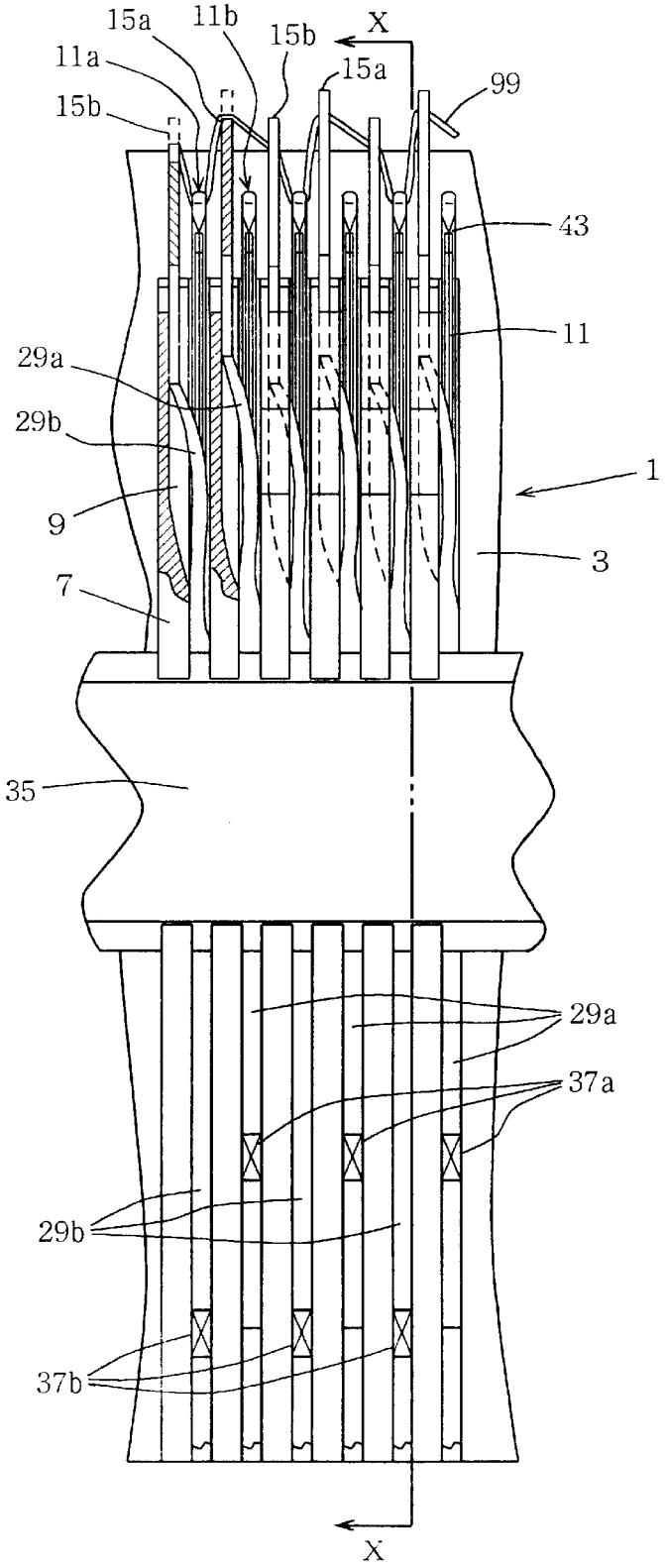
FIG. 1 is a plan view of a needle bed of a first embodiment at the time of half knitting.
Figure 2:
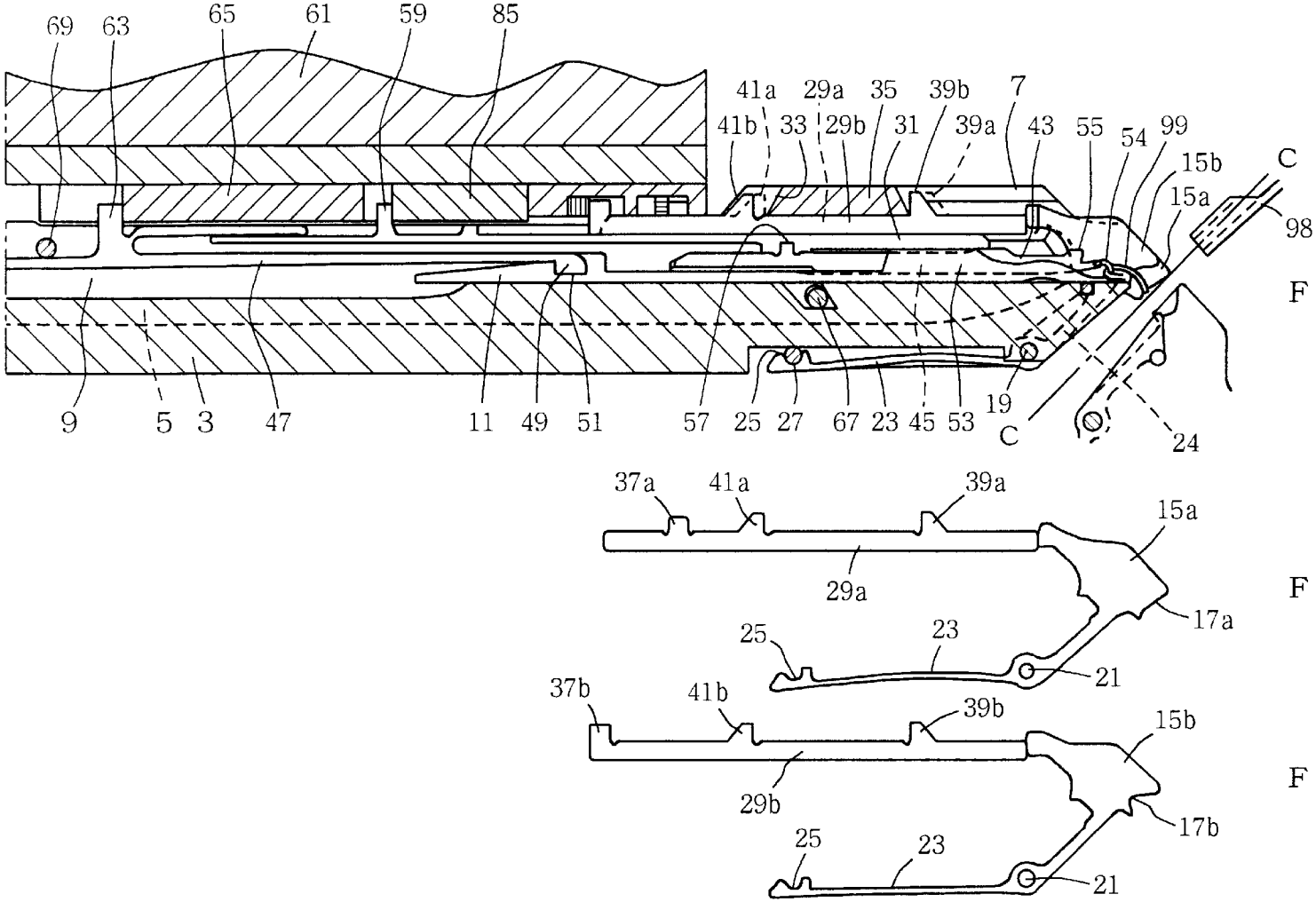
FIG. 2-A is a sectional view along the line X—X of FIG. 1.

With reference to FIG. 1 through FIG. 6, the first embodiment will be described. In the flat knitting machine of the first embodiment, knitting is made by making a first movable loop forming plate 15*a* and a second movable loop forming plate 15*b* move forward or backward between an active position and an inactive position, and both full knitting, that uses all needles to form loops, and half knitting, that uses every other needle to form loops, are made while the balance between sinker loop and needle loop is prevented from being disturbed. FIG. 1 is a plan view of the needle bed at the time of half knitting, FIG. 2 is a sectional view along the line X—X of FIG. 1, and FIG. 2-B and FIG. 2-C are diagrams showing the movable loop forming plates and the movable loop forming plate control members that are extracted from FIG. 2-A. FIG. 2 is a diagram that shows the cam unit and the loci of butts. It should be noted that in FIG. 1 and FIG. 3 needle plates and movable loop forming plates are cut away for easier comprehension.

In the flat knitting machine of the first embodiment, needle plates 7 are provided in grooves 5 that are made in a needle bed base 3 at regular intervals. On a needle bed 1, a needle 11 is held in such a way that it can slide or move forward or backward in a concave needle groove 9 that is composed of sides of a pair of adjacent needle plates 7, 7 and the top of the needle bed base 3. A pair of needle beds 1, 1 are arranged to oppose to each other, one in the front and the other in the back, with the top ends of the needles 11 of one bed being close to those of the other bed. The first movable loop forming plate 15*a* and the second movable loop forming plate 15*b*, differing in configuration from each other, are alternately arranged between needles on the top ends of the needle beds 1, 1 on the trick gap side, over the entire longitudinal lengths of both the front and back needle beds 1, 1. The front and back needle beds 1, 1 are symmetrical, and only one needle bed will be described.

As shown in FIG. 2-A, the movable loop forming plates 15*a*, 15*b* are formed on the trick gap side of the needle bed, and these plates face a center C—C of an opening (trick gap) between both the front and back needle beds. As shown in FIG. 2-B and FIG. 2-C, the movable loop forming plate 15*a*, 15*b* has a loop forming edge 17*a*, 17*b*, an axis hole 21 and a curved elastic leg 23, and is swingably mounted in a groove 24 at the top end of the needle bed. The loop forming edge 17*a*, 17*b* has a push-out action onto a yarn spanning needles. The axis hole 21 is supported by a wire 19 that is put through in the needle bed 1 in the longitudinal direction thereof, and serves as the swing fulcrum for the movable loop forming plate 15*a*, 15*b*. (Parts common to both the first and second movable loop forming parts or to both the first and second movable loop forming plate control parts are indicated by common marks.) In the movable loop forming plate 15*a*, 15*b*, a concave 25 at the top end of the elastic leg 23 is engaged with a wire 27 that is mounted on the needle bed in the longitudinal direction thereof; thus the loop forming edge 17*a*, 17*b* is energized in a direction that the loop forming edge 17*a*, 17*b* moves back from the center C—C of the opening between the front and back needle beds. In the flat knitting machine of the present embodiment, the swing fulcrums of the movable loop forming plates are provided on the bottom of the needle bed on the trick gap side, and the loop forming edges 17*a*, 17*b* are made to swing to move forward or backward in the direction of forward or backward movement of the needle 11. As the pressing members for energizing the movable loop forming blades 15*a*, 15*b* in the direction of moving back from the trick gap are provided on the bottom of the needle bed, there is no need of providing any pressing members on the top of the needle bed or in the pull-down route of a fabric.

The first and second movable loop forming plates 15*a*, 15*b* contact the first and second movable loop forming plate control members 29*a*, 29*b* on which butts are provided in different positions at their back ends. When a movable loop forming plate control member is moved forward or backward, the first or the second movable loop forming plate will be moved forward to or backward from the center C—C of the opening. The control members 29*a*, 29*b* are mounted above slider control jacks 31 of needles 11 that will be described later, in such a way that the control members 29*a*, 29*b* can slide forward or backward. A retainer 35 is mounted in a dovetailed groove 33 that is formed in the needle bed 1 in the longitudinal direction thereof. As a result, the control members 29*a*, 29*b* will not come out of needle grooves and will be retained there while they can slide forward or backward.

Of the first and second movable loop forming plates 15*a*, 15*b*, the first movable loop forming plate 15*a* is provided with a linear loop forming edge 17*a* that is formed at the top end thereof, and the second movable loop forming plate 15*b* is provided with a concave loop forming edge 17*b*. The control member 29*a* is provided with a control butt 37*a*. The second control member 29*b* is provided with a control butt 37*b* in a position behind that of the first movable loop forming plate control member. 39, 41 denote regulating pieces that limit the movable ranges of the control members 29*a*, 29*b*, respectively.

The first movable loop forming plate 15*a* and the second movable loop forming plate 15*b* are provided in such a way that the loop forming edge 17*a* of the first movable loop forming plate 15*a* in its most retracted position and the backmost part, in the direction of forward/backward movement of the needle, of the loop forming edge 17*b* of the second movable loop forming plate 15*b* in its most advanced position overlap with each other when seen from the side. As shown in FIG. 1, the control members 29*a*, 29*b* are curved leftward at their top ends, and their top ends contact the movable loop forming plates 15*a*, 15*b*.

The needle 11 of the flat knitting machine of the present embodiment is composed of a needle body 53, a slider 43, and a slider control jack 31. The needle body 53 slidably holds the slider 43 in a groove 45, and a connecting concave 51 in the back end of the needle body 53 is connected with a connector 49 of a selection jack 47. Moreover, a hook 54 is formed on the needle body 53 at the top end thereof. The slider 43 is provided with a loop holding part 55 at the top end thereof and a control butt 57 in the rear thereof. The slider control jack 31 is integrally connected with the slider 43, and is provided with a control butt 59 in the rear thereof. A control butt 63 is provided on the top face of the selection jack 47. When the control butt 63 is pressed by a presser that is provided on a carriage 61 but is not illustrated, the control butt 63 will be pushed into the needle groove in which it will not engage with a knitting cam 93. The selection jack 47 is selected for knit or miss by a well-known selecting means not illustrated. 67 is a wire that fixes the needle bed base 3 and needle plates 7 together, and 69 is a wire that holds selection jacks in needle grooves. All the needles 11 used in the following embodiments are of the same construction. However, for convenience of description, in FIG. 1, the needle 11*a*, that is arranged to the left of the first movable loop forming plate 15*a* and is advanced at the time of half knitting, is expressed as the first needle. The needle 11*b* that is arranged to the left of the second movable loop forming plate 15*b* and is held in the retracted position at the time of half knitting is expressed as the second needle. The first needle 11*a* and the second needle 11*b* are arranged alternately.

Figure 3:
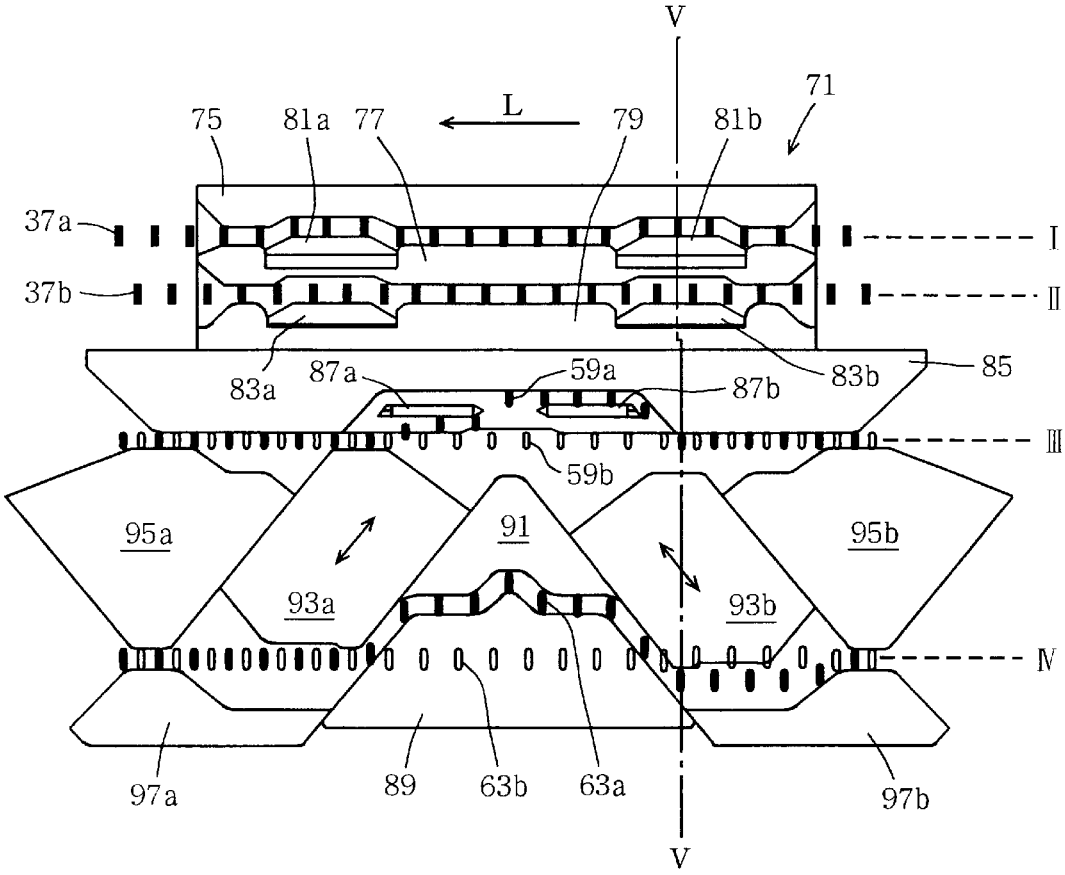
FIG. 3 is a diagram showing a cam unit and loci of butts at the time of half knitting.

The cam unit 71 of the flat knitting machine of the first embodiment is shown in FIG. 3. The arrow L in the diagram indicates the direction of the carriage. FIG. 2-A shows the state of the needle bed along the line V—V of FIG. 3. In FIG. 3, the butt 37*a* of the first control member 29*a* at the time of full knitting is indicated by a black butt, and the butt 37*b* of the second control member 29 is indicated by a black butt. Similarly, in FIG. 3, of butts of the slider selection jack 31 and the selection jack 47, the control butts 59*a*, 63*a* of the first needle 11*a* that is selected for knit in half knitting are indicated by black butts, and the control butts 59*b*, 63*b* of the second needle 11*b* that is selected for miss are indicated by white butts.

The cam unit 71, that is mounted on a carriage 61 that reciprocates over the needle beds in the longitudinal direction, is provided with a movable loop forming plate control cam group that controls the first and second control members 29*a*, 29*b*, a slider cam group that controls the slider control jacks, and a knitting cam group that controls selection jacks. These cams constitute, from above, a path for the first movable loop forming plate control member (I), a path for the second movable loop forming plate control member (II), a path for slider control jack (III), and a path for selection jack (IV). The movable loop forming plate control cam group is composed of an upper cam 75, a middle cam 77 and a bottom cam 79 of fixed type, movable loop forming plate control cams 81*a*, 81*b* that move the first control member 29*a* forward or backward, and movable loop forming plate control cams 83*a*, 83*b* that move the second control member 29*b* forward or backward. The slider control cam group is composed of a slider guide cam 85 and a pair of left and right slider cams 87*a*, 87*b* of fixed type. The knitting cam group is composed of a center raising cam 89 and a guide cam 91 of fixed type, a pair of left and right knitting cams 93*a*, 93*b* that are arranged to be movable in the directions of the arrows, and other guide cams 95*a*, 95*b*, 97*a*, 97*b*.

The movable loop forming plates 15*a*, 15*b* operate in synchronization with the needle 11, and when the needle 11 is operated by stitch cams 93*a*, 93*b* to form a stitch loop, the movable loop forming plates 15*a*, 15*b* regulate the yarn to adjust the size of the sinker loop. The movable loop forming plates act on plain stitch fabrics and hardly act on rib stitch fabrics. Since other features of the flat knitting machine of the present embodiment are common to conventional flat knitting machines, more detailed description will be omitted.

Next, the action of the flat knitting machine of the present embodiment will be described. First, the action for half knitting will be described. In half knitting, the first movable loop forming plate 15*a* is controlled to be in an active position at which the plate 15*a* has a push-out action on a yarn 99, and the second movable loop forming plate 15*b* is controlled to be in an inactive position at which the plate 15*b* has no push-put action on the yarn. To this end, the first control cams 81*a*, 81*b* are controlled to be in active positions, and the second control cams 83*a*, 83*b* are controlled to be in inactive positions. By this, the first movable loop forming plate 15*a* is controlled to be in an advanced position and the second loop forming plate 15*b* is controlled to be in a retracted position. The first needle 11*a* is selected for knit, and the second needle 11*b* is selected for miss, and yarn is continuously fed to the first needles 11*a* to make half knitting. In half knitting, the second needle 11*b* is selected for miss, and the butt 63 of the selection jack 47 is pressed by a presser mechanism not illustrated into the needle groove, and as shown in FIG. 3, the second needle 11*b* travels without contacting the cam group. The first needle 11*a*, that is selected for knit, is raised by the center raising cam 89 to the topmost position, then it is lowered by the guide cam 91 and the knitting cam 93*b* of the trailing side. In the actual knitting, the movable loop forming plates 15*a*, 15*b* are moved forward to or backward from the center C—C of the opening by control cams 81*a*, 83*a* being on the leading side relative to the carriage direction. However, forward or backward movements of the movable loop forming plates 15*a*, 15*b* caused by the control cams 81*a*, 83*a* of the leading side are irrelevant to knitting. Hence, in the present embodiment, only forward or backward movements caused by the control cams 81*b*, 83*b* of the trailing side are described.

In the course of lowering the needle by the knitting cam 93*b*, yarn is fed by a yarn feeder 98 to the hook 54 of the needle 11*a*, next the needle 11*a* holding the yarn 99 in the hook 54 is lowered. At this time, the first movable loop forming plate 15*a* is moved forward to an advanced position by the first control cam 81*b* that is controlled to be in the active position. As a result, the yarn 99 that has been pulled in by the first needle 11*a* contacts the first movable loop forming plate 15*a* being in the active position, then contacts the second movable loop forming plate 15*b* being in the retracted position. At the time, the second movable loop forming plate 15*b* is in the inactive position, and the second movable loop forming plate 15*b* hardly has a push-out action on the yarn, and its construction is similar to that of the flat knitting machine disclosed in Japanese Provisional Patent Hei 7-258945 described in Prior Art. Hence knitting can be made while the balance between sinker loop and needle loop is prevented from being disturbed.

Figure 4:
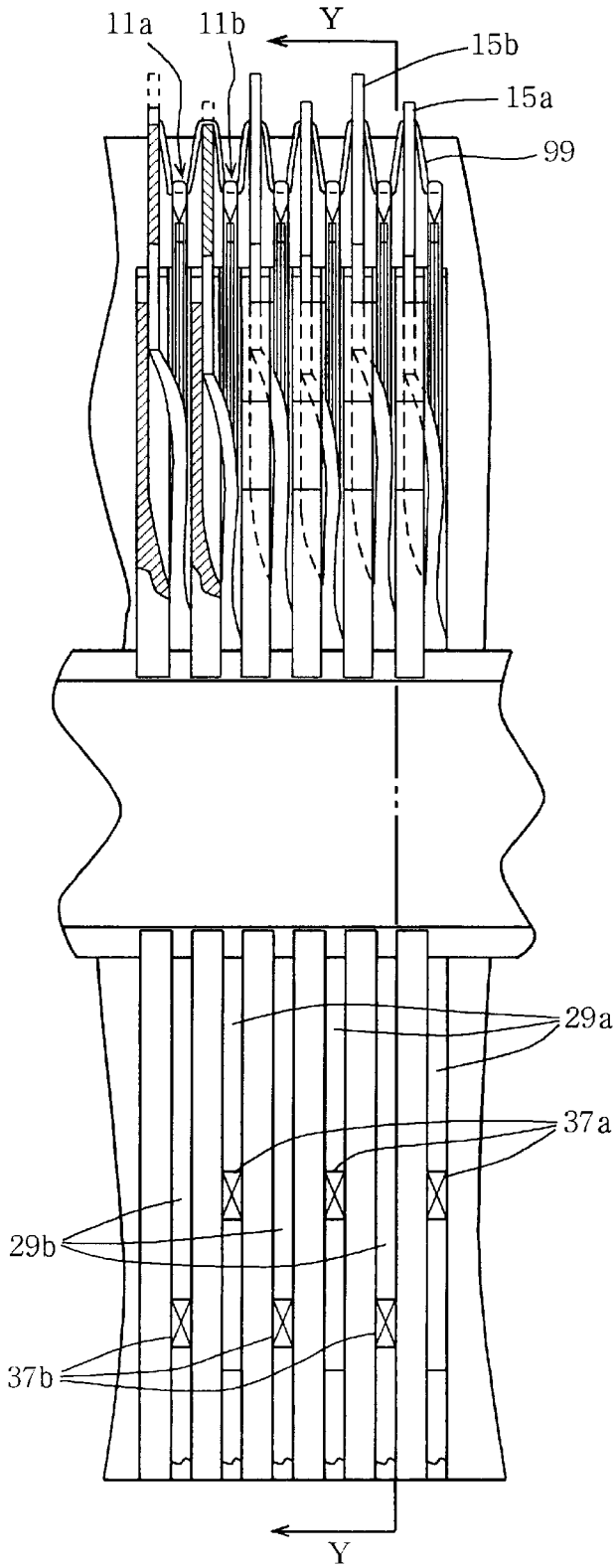
FIG. 4 is a plan view of the needle bed of the first embodiment at the time of full knitting.
Figure 5:
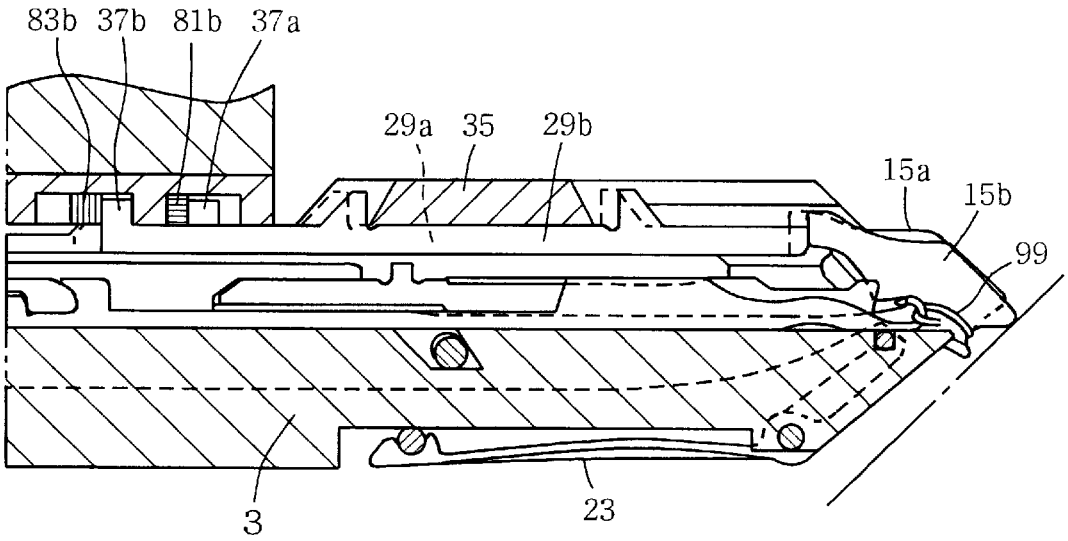
FIG. 5 is a sectional view along the line Y—Y of FIG. 4.
Figure 6:
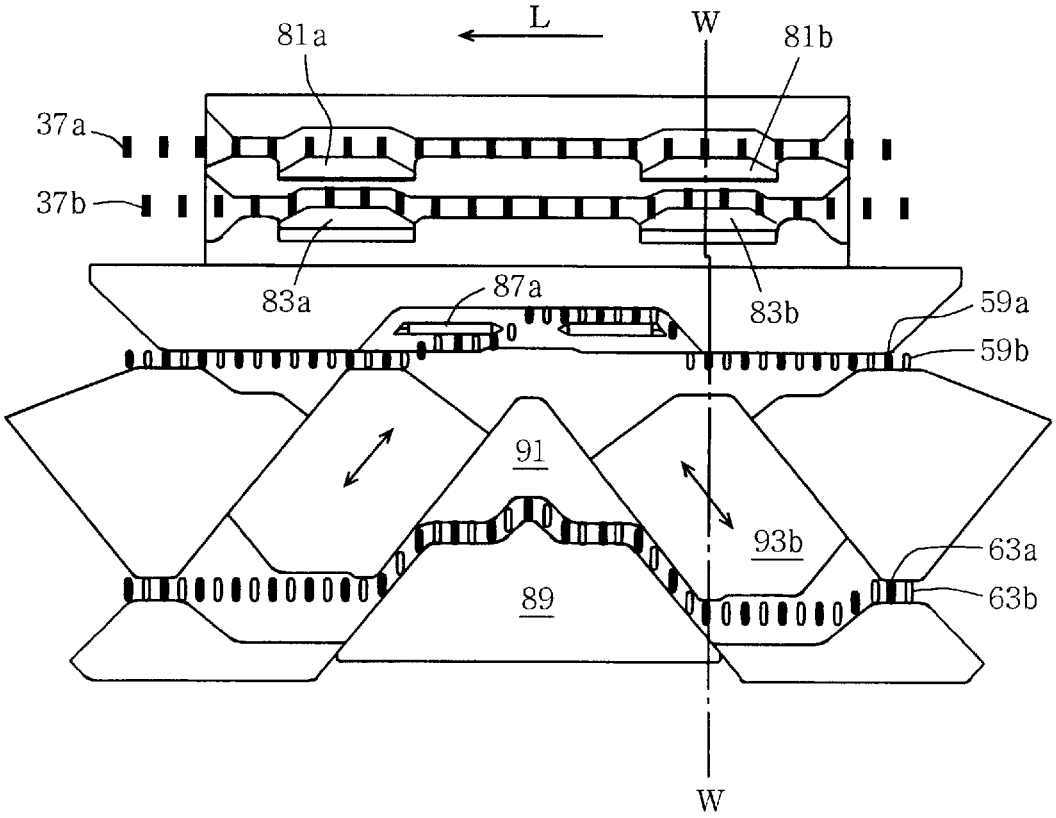
FIG. 6 is a diagram showing the cam unit and loci of butts at the time of full knitting.

Next, with reference to FIG. 4 through 6 that corresponds to FIG. 1 through FIG. 3, the action in full knitting will be described. FIG. 4 is a plan view of the needle bed in full knitting. FIG. 5 is a sectional view along the line Y—Y of FIG. 4. FIG. 6 shows the cam unit and the loci of butts. FIG. 5 shows the state when the line W—W of FIG. 6 is reached.

In full knitting, both the first movable loop forming plate 15*a* and the second movable loop forming plate 15*b* are controlled to be in active positions. For this, the first control cams 81*a*, 81*b* that move the first movable loop forming plate 15*a* forward or backward are controlled to be in inactive positions at which these cams 81*a*, 81*b* do not contact the control butt of the first movable loop forming plate 15*a*, and the second control cam 83*b* is controlled to be in an active position at which the cam 83*b* contacts the control butt of the second movable loop forming plate 15*b*. As a result, the first movable loop forming plate is controlled to be in a retracted position, and the second loop forming plate is controlled to be in an advanced position. Knitting is effected by the first and second needles while the loop forming edges of the first movable loop forming plate and the second movable loop forming plate overlap with each other when seen from the side. With the travel of the carriage 61, the butts 63*a*, 63*b* of the selection jack 47 will contact the center raising cam 89, and the needle body 53 will be raised. The slider 43 will be pushed by the needle body 53 to rise. As a result, the butts 59*a*, 59*b* of the slider control jack 31 of the first and second needles 11*a*, 11*b* will contact the slider guide cam 87*a*, and any ascent beyond that will be limited. The slider 43 will descend relative to the needle body 11, and the hooks 54 of the needles 11*a*, 11*b* will be opened.

The needles 11*a*, 11*b* are raised to the topmost positions by the center raising cam 89, then they are lowered by the guide cam 91 and the knitting cam 93*b* on the trailing side relative to the carriage direction. At this time, the second movable loop forming plate 15*b* is made by the second movable loop forming plate control cam 83*b* to advance to the advanced position. Under this condition, yarn 99 is fed into the hook 54 of the needle 11 by the yarn feeder that is travelling with the carriage 61. When the carriage 61 travels further, the needles 11*a*, 11*b* will be lowered by the knitting cam 93*b*. At this time, the first movable loop forming plate 15*a* is controlled to be in the retracted position, and the second movable loop forming plate 15*b* is controlled to be in the advanced position, and the loop forming edges of the first and second movable loop forming plates are controlled to be in positions at which they overlap with each other when seen from the side. As a result, the yarn 99 is pulled in by the needles 11*a*, 1 lb, and the amount of push-out of the sinker loop by the first movable loop forming plate 15*a* and that by the second movable loop forming plate 15*b* are equal; thus loops having an equal sinker loop length are formed by the first and second needles 11*a*, 11*b*.

As described above, in the flat knitting machine of the present embodiment, loop forming edges facing the center C—C of the opening between both the front and back needle beds are formed on both needle beds on the trick gap side thereof. Movable loop forming plates 15*a*, 15*b* are supported by fulcrums provided on the needle bed near the bottom of the trick gap so that the plates 15*a*, 15*b* swing in the grooves 24 formed in the needle bed at the top end on the trick gap side between the advanced position at which the loop forming edges 17*a*, 17*b* are advanced most towards the center of the opening between both the front and back needle beds and the retracted position at which the loop forming edges 17*a*, 17*b* are retracted most. Because of this, when the movable loop forming plates 15*a*, 15*b* are moved forward or backward, the loci of the forward/backward movements of the loop forming edges 17, 17*b* can be easily realized in a direction along the forward/backward movement of the needles that is the optimal direction for pushing out the sinker loop. Moreover, as the swing fulcrums of the movable loop forming plates 15*a*, 15*b* are provided on the needle bed at the bottom of the trick gap, and the plates 15*a*, 15*b* are held so that they can swing in the grooves 24 formed in the needle bed on the trick gap side, the movable loop forming plates 15*a*, 15*b* can be provided without generating any structure that may hinder knitting on the needle beds or in the pull-down loci of fabrics. Furthermore, as knitting is done by selecting half knitting, in which the first movable loop forming plate is controlled to be in the active position and the second movable loop forming plate is controlled to be in the inactive position, or full knitting, in which both the first and second movable loop forming plates are controlled to be in active positions, both half knitting and full knitting can be made while the balance between sinker loop and needle loop is prevented from being disturbed.

In this embodiment, the most retracted position of the first movable loop forming plate 15*a* and the most advanced position of the second movable loop forming plate 15*b* are the same position, and the travel ranges of the first movable loop forming plate 15*a* and the second movable loop forming plate 15*b* are made to differ from the advancing direction of the needle. The first movable loop forming plate are arranged to be active in both the advanced position and the retracted position, and the second movable loop forming plate is arranged to be active in the advanced position and is inactive in the retracted position. In this way, the amount of travel of each movable loop forming plate control member is reduced. However, the above-mentioned arrangement is not essential. For example, the advanced positions of both the first and second movable loop forming plates 15*a*, 15*b* may be set at the most advanced position of the first movable loop forming plate, and the retracted positions of both the plates 15*a*, 15*b* may be set at the most retracted position of the second movable loop forming plate, and at the same time, the amount of advancement of the movable loop forming plate control cam is made adjustable. Then actions and inaction of the first and second movable loop forming plates 15*a*, 15*b* can be switched over.

Further, in the present embodiment, in half knitting, under a condition that the difference between needle loop and sinker loop is within the tolerance, the retracted position of the second movable loop forming plate 15*b* is set at a position at which the yarn 99 contacts the loop forming edge 17*b* of the second movable loop forming plate 15*b*. Hence the loop forming edge 17*b* has a slight push-out action on the yarn. However, it may be arranged that the loop forming edge 17*b* of the second movable loop forming plate 15*b* can be retracted to a position at which the edge 17*b* does not contact the yarn 99 at all. In full knitting, knitting is done by controlling so that the loop forming edges 17*a*, 17*b* of the first movable loop forming plate 15*a* and the second movable loop forming plate 15*b* come to the same position when seen from the side. However, under a condition that the difference between sinker loop and needle loop is within the tolerance, knitting may be done by controlling the loop forming edge 17*a* of the first movable loop forming plate 15*a* and the loop forming edge 17*b* of the second movable loop forming plate 15*b* to be in different positions. Moreover, in the above-mentioned embodiment, movable loop forming plates 15*a*, 15*b* of which loop forming edges differ from each other in configuration are used as the first and second movable loop forming plates. However movable loop forming plates of which loop forming edges are identical to each other in configuration may be used as the first and second movable loop forming plates.

<Second Embodiment>

Figure 8:
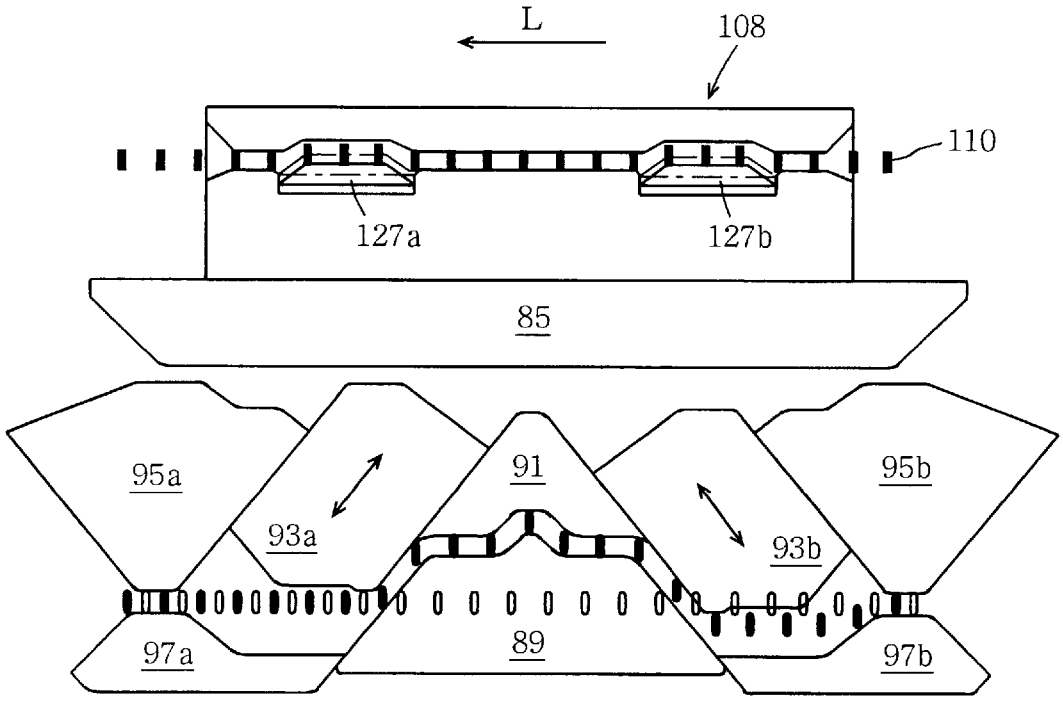
FIG. 8 is a diagram showing the cam unit and loci of butts of the second embodiment at the time of half knitting.

Next, with reference to FIG. 7 through FIG. 9, a second embodiment will be described. In the second embodiment, a movable loop forming plate 101 of a single kind and a fixed type loop forming plate 103 are alternately arranged between needles. Like the first embodiment, one object is to make both half knitting and full knitting while the balance between sinker loop and needle loop is prevented from being disturbed. Since the basic configurations of the second and subsequent embodiments are common to that of the first embodiment, parts identical to those of the first embodiment will be described with the same marks that were used in the first embodiment. A side view of a flat knitting machine of the second embodiment is shown in FIG. 7. FIG. 7-A is a sectional view of a needle bed 105 of the flat knitting machine of the second embodiment. FIG. 7-B and FIG. 7-C are diagrams showing the fixed loop forming plate 103, the movable loop forming plate 101, and a movable loop forming plate control member 107 that are extracted from FIG. 7-A. FIG. 8 shows a cam unit 108 for half knitting, and FIG. 9 shows a cam unit for full knitting.

In the flat knitting machine of the second embodiment, the movable loop forming plate 101 and the fixed type loop forming plate 103 are alternately arranged between needle grooves. The movable loop forming plate 101 is provided with a loop forming edge 129, and this edge 129 has the same configuration as the loop forming edge 17*a* of the first movable loop forming plate 15*a* used in the first embodiment. The most retracted position of the movable loop forming plate 101 is set behind the most retracted position of the first movable loop forming plate 15*a* of the first embodiment. The fixed type loop forming plate 103 is provided with a loop forming edge 109, and this edge 109 has the same configuration as the loop forming edge 17*b* of the second movable loop forming plate 15*b* used in the first embodiment. The fixed type loop forming plate 103 is set at the same position as the most retracted position of the second movable loop forming plate of the first embodiment. The movable loop forming plate 101 is operated to move forward or backward through a butt 110 of the control member 107 that engages with the cam unit 108. The fixed type loop forming plate 103 is fixed by engaging its concaves 113, 119 with wires 111, 117 that are mounted on the needle bed in the longitudinal direction thereof. In a needle groove 115 in which the fixed type loop forming plate 103 is mounted, a spacer 120 is mounted between the top of a needle 125 and a retainer 122. In the second embodiment, a case of using a latch needle 125 will be described. A hook 123 of this latch needle 125 is opened or closed by turning a latch 121. It should be noted that in the second embodiment the compound needle, that was used in the first embodiment, can be used as well. In other embodiments of the present invention, both latch needle and compound needle can be used.

Figure 9:
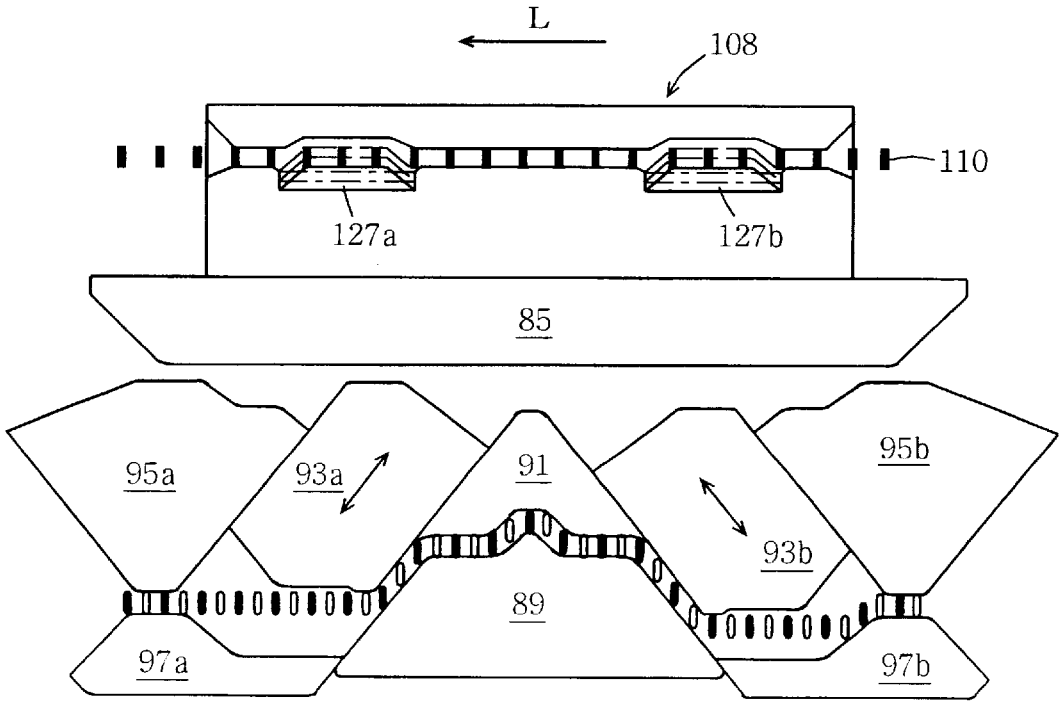
FIG. 9 is a diagram showing the cam unit and loci of butts of the second embodiment at the time of full knitting.

The cam unit of the second embodiment is prepared by, as shown in FIG. 8 and FIG. 9, omitting cams for moving forward or backward the second movable loop forming plate and cams for slider control from the cam unit 71 of the first embodiment, and providing movable loop forming plate control cams 127*a*, 127*b* of which strokes are extended than that of the first movable loop forming plate control cam. FIG. 8 shows the cam unit in half knitting and FIG. 9 shows the cam unit in full knitting.

The action of the flat knitting machine of the second embodiment will be described. In the case of half knitting, the movable loop forming plate control cams 127*a*, 127*b* are controlled to be in active positions, and the loop forming edge 129 of the movable loop forming plate 101 is controlled to be in an advanced position more advanced than the loop forming edge 109 of the fixed loop forming plate 103. Then, the first needle is selected for knit, and the second for miss. Yarn is fed to every other first needle to knit. Since the fixed loop forming plate 103 is at the same position as the most retracted position of the second movable loop forming plate 15*b* of the first embodiment, the push-out of the loop by the fixed loop forming plate 103 is slight. As a result, the yarn fed to the first needles can be formed into stitches while the balance between sinker loop and needle loop is prevented from being disturbed. In the case of full knitting, the movable loop forming plate control cams 127*a*, 127*b* are controlled to be in inactive positions, and the movable loop forming plate 101 is controlled to be in a retracted position that is an active position. Then, knitting can be made with the loop forming edge 129 of the movable loop forming plate 101 and the loop forming edge of the fixed loop forming plate 103 overlapping with each other when seen from the side. By this, the amount of push-out of sinker loop by the movable loop forming plate 101 and that by the fixed type loop forming plate 103 are equalized. Thus loops of the same sinker loop length are formed by the first and second needles.

<Third Embodiment>

Next, with reference to FIG. 10, a third embodiment will be described. FIG. 10-A is a sectional view of a needle bed 203 of a flat knitting machine of the third embodiment. FIG. 10-B is a diagram showing a movable loop forming plate 201 and a control member 205 that are extracted from FIG. 10-A. In the third embodiment, the movable loop forming plate 201 of a single kind is arranged between all needles. When a single bed knit structure, that is knitted by using needles of one needle bed, and a double beds knit structure, that is knitted by using needles of both the front and back needle beds, are formed in the same course, or when a single bed knit structure and a double beds knit structure are continuously knitted in the direction of course, this embodiment is used to knit while the loop balance between the single bed knit structure portion and the double beds knit structure portion is prevented from being disturbed. The movable loop forming plate 201 and the movable loop forming plate control member 205 that are used in the present embodiment have construction common to that of the movable loop forming plate 101 and the movable loop forming plate control member 107 of the second embodiment. The cam unit that is used in the third embodiment has construction common to that of the cam unit 108 of the second embodiment. Hence, in the following description, marks used in the second embodiment will be used.

The action of the flat knitting machine of the third embodiment will be described. In the third embodiment, when full knitting is made, for a course or a fabric of a single bed knit structure, the movable loop forming plate control cams 127*a*, 127*b* are controlled to be, for example, in inactive positions. As a result, sinker loops of a single bed knit structure are made smaller relatively. For a course or a fabric of a double beds knit structure, or for a course or a fabric in which a single bed knit structure and a double beds knit structure are present in mixture, the control cams 127*a*, 127*b* are controlled to be in active positions. In a double beds knit structure, the movable loop forming plate hardly contact sinker loops. The movable loop forming plate is effective only in a single bed knit structure. As a result, sinker loops of the single bed knit structure are made longer relative to the double beds knit structure; thus the difference in sinker loop length between different structures is reduced.

In the case of a fabric in which both a course of only single bed knit structure and a mixed course with double beds knit structure are present, if in the mixed course the sinker loop of the single bed knit structure is extended, and in the course of only single bed knit structure the sinker loop is kept at the normal value (the movable loop forming plate is not active), the stitch size will vary in the fabric. Hence it is desirable, when the above-mentioned mixed course is present, to make the movable loop forming plate active for the entire fabric.

It is desired that the amounts of movement of the control cam 127*a*, 127*b* and the control member 205 can be varied in multiple stages rather than in two stages of 0/1 and that the position of the movable loop forming plate is adjusted according to the knitting conditions such as the property of the yarn to be used in knitting. The knock over timing when the yarn is knocked over from a needle can be adjusted by changing the position of the movable loop forming plate. Thus a desired texture or feeling can be realized without being influenced by the property of the yarn whether it is easily knocked over or not.

<Fourth Embodiment >

With reference to FIG. 11, a fourth embodiment will be described. FIG. 11-A is a plan view of a needle bed 301 of a flat knitting machine of the fourth embodiment. FIG. 11-B is a sectional view along the line Z-Z of FIG. 11-A. FIG. 11-C is a diagram showing a movable sinker plate 303 that is extracted from FIG. 11-A. FIG. 11-D is a diagram showing a movable loop forming plate 305, a movable loop forming plate control member 307 and a retainer 309. In the flat knitting machine of the fourth embodiment, the well-known movable sinker plate 303, that prevents rising of an old loop together with rising of a needle, and the movable loop forming plate 305 are provided in layers at the top end of the needle bed. The movable sinker plate 303 is held in a groove formed in the needle plate 311, with a J-shaped leg 315 serving as the fulcrum. The plate 303 is energized by a spring 319 that engages with a holder 317 of the movable sinker plate 303, in a direction that the plate 303 pushes a loop into the trick gap between the front and back needle beds. A pair of control butts 321*a*, 321*b* for swing control, one in the front and one in the back, are formed on the top of the movable sinker plate 303. The movable sinker plate 303 is swingably retained by mounting a retainer 325 in a groove 323 that is formed in the needle bed in the longitudinal direction thereof between the control butts 321*a*, 321*b*. The top end 329 of the movable sinker plate 303 is made to swing in a groove 333 formed in the needle plate base 331. An end 337 of the movable loop forming plate is bent towards the needle groove, and the back end is positioned in the needle groove, and the movable loop forming plate is controlled to move forward or backward by the movable loop forming plate control member 307 mounted in the needle groove.

The movable loop forming plate 305 makes a U-shaped portion 305, that is formed on one end thereof, contact the bottom 339 of the needle bed. With this arrangement, the loop forming edge 341 is energized in a direction that the loop forming edge 341 advances towards the center of the opening between both the front and back needle beds. In the middle of the movable loop forming plate 305, is formed a concave 343 that uses a wire 347, that is put through in the longitudinal direction of the needle bed, as the swing fulcrum to hold the movable loop forming plate 305. 345 is a wire that regulates the upward movement and the most retracted position of the movable loop forming plate 305 in the movable sinker groove 333. The wire 347 is held by a retainer 351 that is spanned between the wires 345,349 mounted on the bottom of the needle bed. The cam unit of the present embodiment is the cam unit 108 of the second embodiment to which cams for controlling the well-known movable sinker are added.

The action of the flat knitting machine of the present embodiment will be described. In the flat knitting machine of the present embodiment, the movable loop forming plate 305 and the movable sinker plate 303 are individually moved forward or backward according to the movement of the needle 353 to effect knitting. In the flat knitting machine of the present embodiment, rising of an old loop when the needle 353 rises is prevented by the movable sinker plate 303. When the movable sinker plate 303 is advanced towards the center of the opening between the front and back needle beds, the yarn that is in contact with the loop forming edge 341 of the movable loop forming plate 305 will be reliably caught by a yarn holder 327 of the movable sinker plate 303. In the flat knitting machine of the present embodiment, the function of the loop forming edge at the time of loop formation is concentrated in the movable loop forming plate. As a result, the movable sinker plate can be designed to have a configuration and a movement locus that are suitable for pushing down the loop.

In the embodiments, the working of the present invention were described by taking cases of two-bed flat knitting machines that are provided with only a pair of a front needle bed and a back needle bed. However, the present invention can be worked on four-bed flat knitting machines that have a pair of lower needle beds, one in the front and one in the back, and an upper bed on each of lower beds. In the respective embodiments, are provided pressing members that energize the movable loop forming plates in a direction that the movable loop forming plates are retracted from the center of the opening between the front and back needle beds. However, these pressing members may be omitted. The constructions of the knitting machines described in the embodiments indicate some examples of the embodiments of the present invention, and the present invention is not limited to the constructions indicated in the above-mentioned embodiments.

What is claimed is:

1. A flat knitting machine having at least a pair of needle beds, each needle bed slidably holding a plurality of needles in needle grooves formed on said needle beds, said needle beds abutting each other at top ends of said needle beds and defining an opening between said top ends wherein at least one of said needle beds is slidable sideways relative to the flat knitting machine wherein said needles are slidable to and away from said opening, said flat knitting machine comprising:

a plurality of movable loop forming plates movable to and away from said opening in parallel with said needles;

each of said movable loop forming plates having a loop forming edge at a top end of the plate facing said opening;

movement control means for moving each of said movable loop forming plates so that said loop forming edges move to and away from said opening, each of said movable loop forming plates comprise first movable loop forming plates and second movable loop forming plates;

said movement control means comprises first control means for moving said first movable loop forming plates to and away from the opening and second control means for moving said second movable loop forming plates to and away from the opening so that one of half knitting, wherein loop forming edges of said first movable loop forming plates are made active by said first control means and loop forming edges of said second movable loop forming plates are made inactive by said second control means so as to feed every other of said needles with yarn, and full knitting, wherein said loop forming edges of said first movable loop forming plates and said second movable loop forming plates are both made active by said first control means and second control means so as to feed each of said needles with yarn, is selectively performed.

2. A flat knitting machine having at least a pair of needle beds, each needle bed slidably holding a plurality of needles in needle grooves formed on said needle beds, said needle beds abutting each other at top ends of said needle beds and defining an opening between said top ends wherein at least one of said needle beds is slidable sideways relative to the flat knitting machine wherein said needles are slidable to and away from said opening, said flat knitting machine comprising:

a plurality of movable loop forming plates movable to and away from said opening in parallel with said needles;

each of said movable loop forming plates having a loop forming edge at a top end of the plate facing said opening; and movement control means for moving each of said movable loop forming plates so that said loop forming edges move to and away from said opening, wherein said movable loop forming plates are provided to one of every two of said needles, and fixed loop forming plates are provided to remaining needles so that both half knitting, wherein the loop forming edges of the movable loop forming plates are advanced towards the opening so as to feed every other needle with yarn, and full knitting, wherein the loop forming edges of the movable loop forming plates are retracted from the opening so as to feed each needle with yarn, are enabled.

3. A flat knitting machine of claim 2 characterized in that a plurality of movable sinker plates are provided so that each of said movable sinker plate is overlapped with one of said movable loop forming plate, that said movable sinker plates are provided, at a top end thereof, with yarn holding means for holding yarn spanned between needles and movable forward to and backward from the opening and prevent old loops held by needles from being raised during forward movement of the needles, and that each of said yarn holding means and a loop forming edge overlapped with it are made to cross with each other by the forward/backward movement of the movable sinker plate and the forward/backward movement of the movable loop plate.

4. A flat knitting machine having at least a pair of needle beds, each needle bed slidably holding a plurality of needles in needle grooves formed on said needle beds, said needle beds abutting each other at top ends of said needle beds and defining an opening between said top ends, wherein at least one of said needle beds is slidable sideways relative to the flat knitting machine, wherein said needles are slidable to and away from said opening, said flat knitting machine comprising:

a plurality of movable loop forming plates movable to and away from said opening in parallel with said needles;

each of said movable loop forming plates having a loop forming edge at a top end of the plate facing said opening; and movement control means for moving each of said movable loop forming plates so that said loop forming edges move to and away from said opening, wherein each of said movable loop forming plates are sunk partly in grooves formed on bottoms of the needle beds facing said opening, wherein each of said movable loop forming plates are supported by said grooves and free to rock so as to advance towards and retract from said opening according to the control of said movement control means, wherein said loop forming edges are pressed by pressing members so as to move away from a center of said opening, and wherein said movement control means makes each of said loop forming plates move towards the center of said opening against the press by the pressing members.

5. A flat knitting machine of claim 4 characterized in that said bottoms of the needle beds facing the opening are provided with fulcrums for the rocking motion of the movable loop forming plates, that each of said pressing member is configured by an elastic leg provided in each of said loop forming plates and extending from one of said fulcrums oppositely to the loop forming edge of said each of said loop forming plates, and that said elastic leg is in contact with the bottom of the needle bed supporting said each of said loop forming plates.

6. The flat knitting machine of claim 1 further comprising a plurality of movable sinker plates provided so that each of said movable sinker plates is overlapped with one of said movable loop forming plates, wherein said movable sinker plates are provided, at a top end thereof, with yarn holding means for holding yarn spanned between said needles and movable forward to and backward from the opening and prevent old loops held by said needles from being raised during forward movement of the needles, wherein each of said yarn holding means and a loop forming edge overlapped therewith cross each other by the forward to and backward from movement of the movable sinker plate and the forward to and backward from movement of the movable loop plate.

* * * * *